US006968790B1

(12) United States Patent
Kocsis

(10) Patent No.: US 6,968,790 B1
(45) Date of Patent: Nov. 29, 2005

(54) PORTABLE PICNIC TABLE/SAWHORSE

(76) Inventor: Richard L. Kocsis, 10274 Hanover Town Rd., Mechanicsville, VA (US) 23116

( * ) Notice: Subject to any disclaimer, the term of this patent is extended or adjusted under 35 U.S.C. 154(b) by 0 days.

(21) Appl. No.: 11/132,256

(22) Filed: May 19, 2005

(51) Int. Cl.[7] ..... A47B 13/00

(52) U.S. Cl. ..... 108/157.1; 182/151; 182/186.5; 108/11; 297/440.13

(58) Field of Search ..... 297/158.5, 440.13; 248/165, 223.41; 403/381, 298, 296, DIG. 13; 108/180, 186, 187, 101, 11, 13, 155, 157.1, 108/158.18, 159, 158.12; 182/186.5, 181.1, 182/151

(56) References Cited

U.S. PATENT DOCUMENTS

| | | | | | |
|---|---|---|---|---|---|
| 733,500 | A | * | 7/1903 | Moore | 403/376 |
| 797,362 | A | * | 8/1905 | Vall | 108/159 |
| 2,077,414 | A | * | 4/1937 | Hunting | 108/123 |
| 2,504,531 | A | * | 4/1950 | Johnson | 108/167 |
| 2,599,404 | A | * | 6/1952 | McLemore | 248/165 |
| 2,911,265 | A | | 11/1959 | Hannah | |
| 3,035,650 | A | * | 5/1962 | Friedl | 177/208 |
| 3,262,405 | A | * | 7/1966 | Sutton | 108/158.12 |
| 3,463,099 | A | * | 8/1969 | Doucette | 108/167 |
| 4,182,432 | A | | 1/1980 | Cossitt | |
| 4,433,753 | A | * | 2/1984 | Watson | 182/151 |
| 4,574,917 | A | * | 3/1986 | Stoddard | 182/151 |
| 4,890,693 | A | * | 1/1990 | O'Brien | 185/151 |
| 5,367,964 | A | | 11/1994 | Hockensmith | |
| 5,417,307 | A | * | 5/1995 | McIntyre et al. | 182/181.1 |
| 5,501,158 | A | * | 3/1996 | Cheney | 108/165 |
| 5,518,082 | A | * | 5/1996 | Liao | 182/181.1 |
| 5,526,897 | A | | 6/1996 | Schiller | |
| 5,582,267 | A | * | 12/1996 | Bockoven et al. | 182/153 |
| 5,644,995 | A | | 7/1997 | Gurwell et al. | |
| 6,443,076 | B1 | | 9/2002 | Case, Jr. | |
| 6,619,601 | B1 | * | 9/2003 | Vall | 248/188 |
| D493,236 | S | * | 7/2004 | Frey | D25/67 |
| 2004/0011259 | A1 | * | 1/2004 | Meadows | 108/115 |
| 2005/0115768 | A1 | * | 6/2005 | Frey | 182/186.5 |

FOREIGN PATENT DOCUMENTS

| | | |
|---|---|---|
| GB | 2194732 A | 3/1988 |
| WO | WO 93/12692 | 7/1993 |
| WO | WO 95/21558 | 8/1995 |

* cited by examiner

*Primary Examiner*—Janet M. Wilkens
(74) *Attorney, Agent, or Firm*—Richard C. Litman

(57) ABSTRACT

A portable picnic table/sawhorse and bench furniture set. The picnic table/sawhorse includes a tabletop having spaced cross member guides and guide rib on the underside of said tabletop. A pair of sawhorses have lengthwise grooves in their spines to receive the cross members and supporting the tabletop. The sawhorses have generally triangular end supports for each spine The spine has a main support forms an upper tongue and a tenon spaced below the upper tongue, each extending from respective ends of the spine joint main support member. Upper tongues and lower tenons are removably engaged with corresponding grooves and mortises in each table end support. The furniture set includes a pair of benches having similar joinery. Removable pins are provided for each joint in the sawhorses and benches.

17 Claims, 7 Drawing Sheets

PORTABLE PICNIC TABLE/SAWHORSE

BACKGROUND OF THE INVENTION

1. Field of the Invention

The present invention relates to lawn furniture. More particularly, the present invention is a portable, combination picnic table and benches and carpentry sawhorse.

2. Description of the Related Art

Portable picnic tables which break down into parts for movement to another area or for storage are known. Known designs are inherently complicated and the joints are subject to deterioration, resulting in a shaky assembly or broken parts. It would be desirable to provide a portable picnic table assembly which can easily be broken down, yet provides for a solid table assembly and benches for picnic use. It would also be desirable to provide such an assembly which may be used as a sawhorse for carpentry work.

None of the above inventions and patents, taken either singly or in combination, is seen to describe the instant invention as claimed. Thus, a portable picnic table solving the aforementioned problems is desired.

SUMMARY OF THE INVENTION

The present invention is a portable picnic table/sawhorse and bench furniture set. The picnic table/sawhorse includes a generally rectangular tabletop having spaced cross member guides and a centrally located guide rib on the underside of the tabletop. The guide rib extends perpendicularly between the cross member guides. A pair of spaced sawhorse table supports are configured similarly to a pair of sawhorses, each having a spaced pair of generally triangular end supports, each end support having an upper crossbeam, a lower cross beam, and opposed sloping legs. The sawhorse end supports are truncated at the upper cross beam to form spine member support surfaces thereon, the upper cross beam defining a centrally located groove dividing the support surfaces, and a mortise spaced below the groove.

A spine extends between and has end portions to engage with the sawhorse end supports, the spine having upper surface members defining a center groove therebetween and extending downward to form a depending spine joint main support member. The center grooves receive the cross member guides of the table top for assembling the picnic table. The spine joint main support member forms an upper tongue and a tenon spaced below the upper tongue, each extending from respective ends of the spine joint main support member. The upper tongues and lower tenons are removably engaged with corresponding grooves and the mortise in each sawhorse end support.

The furniture set includes a pair of benches. Each bench has an elongate bench seat member having a centrally located spine member depending therefrom. Each bench has a pair of generally triangular bench end supports having an upper cross beam, a lower cross beam, and opposed sloping legs, generally triangular bench end supports being truncated at the upper cross beam to form seat member guide support surfaces. The upper crossbeam defines a centrally located groove dividing the guide support surfaces, and a mortise spaced below the groove. The centrally located spine members form an upper tongue and a tenon spaced below the upper tongue, each extending from respective ends of the spine joint main support member. The upper tongues and lower tenons are removably engaged with corresponding grooves and mortises in each respective bench end supports.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a combination portable picnic table and benches and carpentry sawhorse. The picnic table and benches and carpentry sawhorse includes a set of parts for easy assembly and disassembly for moving between picnic and job sites.

Figure 1:
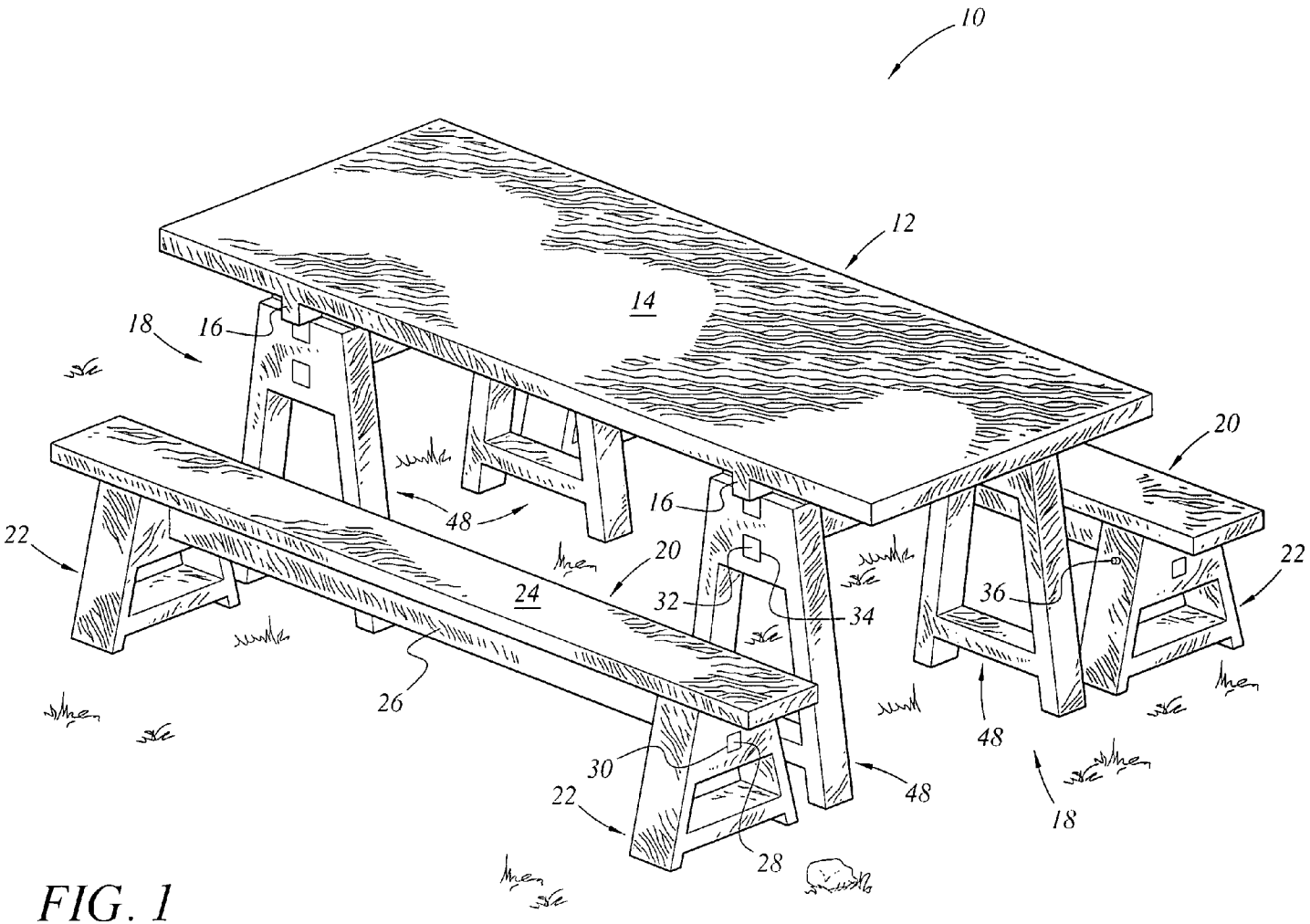
FIG. 1 is a perspective view of a portable picnic furniture set according to the present invention.
Figure 2A:
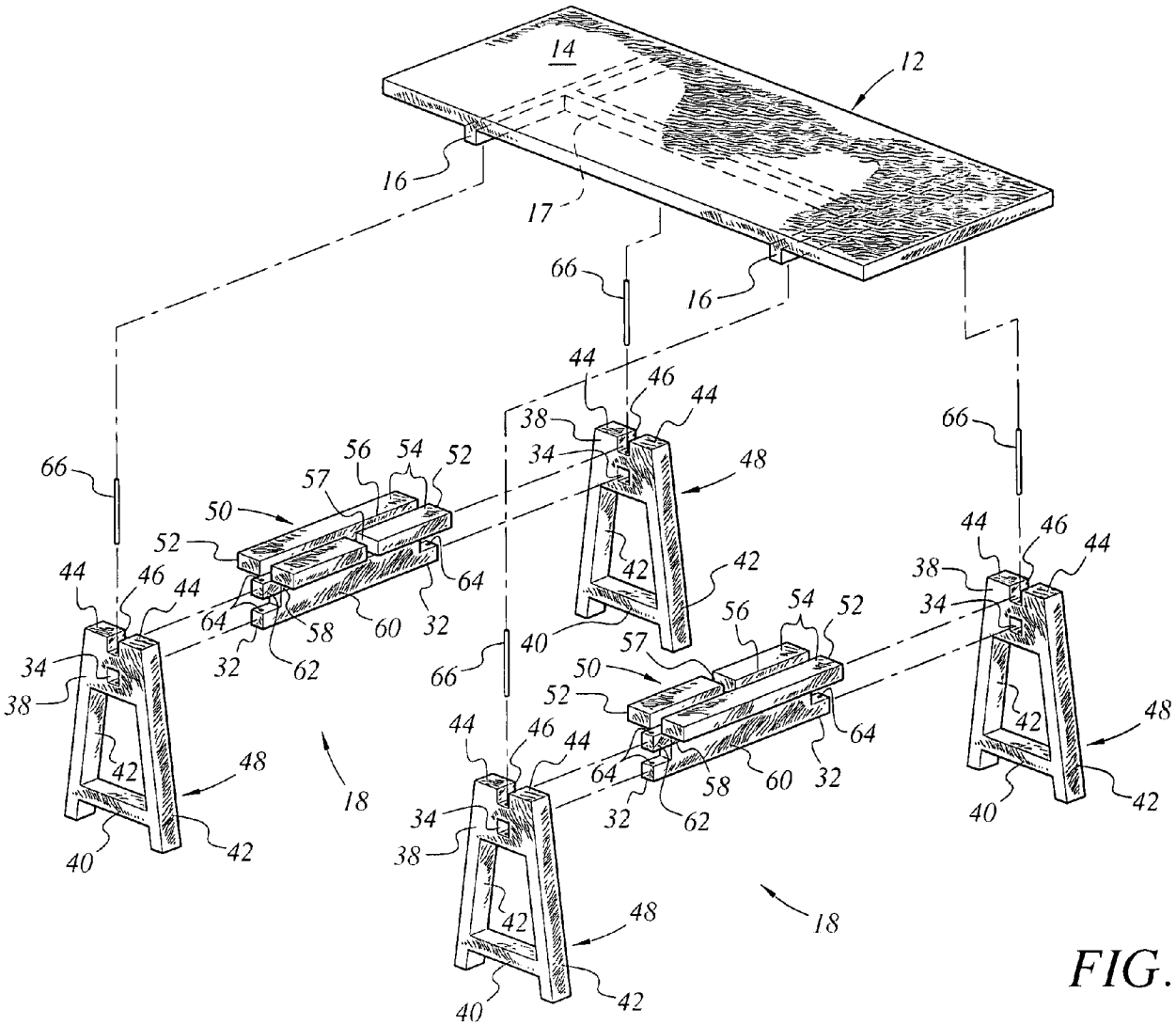
FIG. 2A is an exploded view of the table of FIG. 1.

Referring to FIG. 1, there is shown a picnic furniture set 10, including picnic table 12 having flat top 14 with cross member guides 16 on its underside. A centrally disposed guide rib 17 extends perpendicularly between cross member guides 16. The tabletop 14 is supported by spaced sawhorse supports 18, serving as tabletop supports. Picnic furniture set 10 includes benches 20 of similar construction to sawhorse supports 18 of table 12. Benches 20 have an elongate seat 24 having a supporting spine member 26 depending from its underneath side. Benches 20 each have a pair of end supports 22 attached to spine 26 by receiving respective tenons 28 into mortises 30 in end supports 22. Picnic table sawhorse supports 18 have end supports 48 which receive respective tenons 32 into mortises 34 extending from sawhorse spine 50 (see FIG. 2).

Figure 2B:
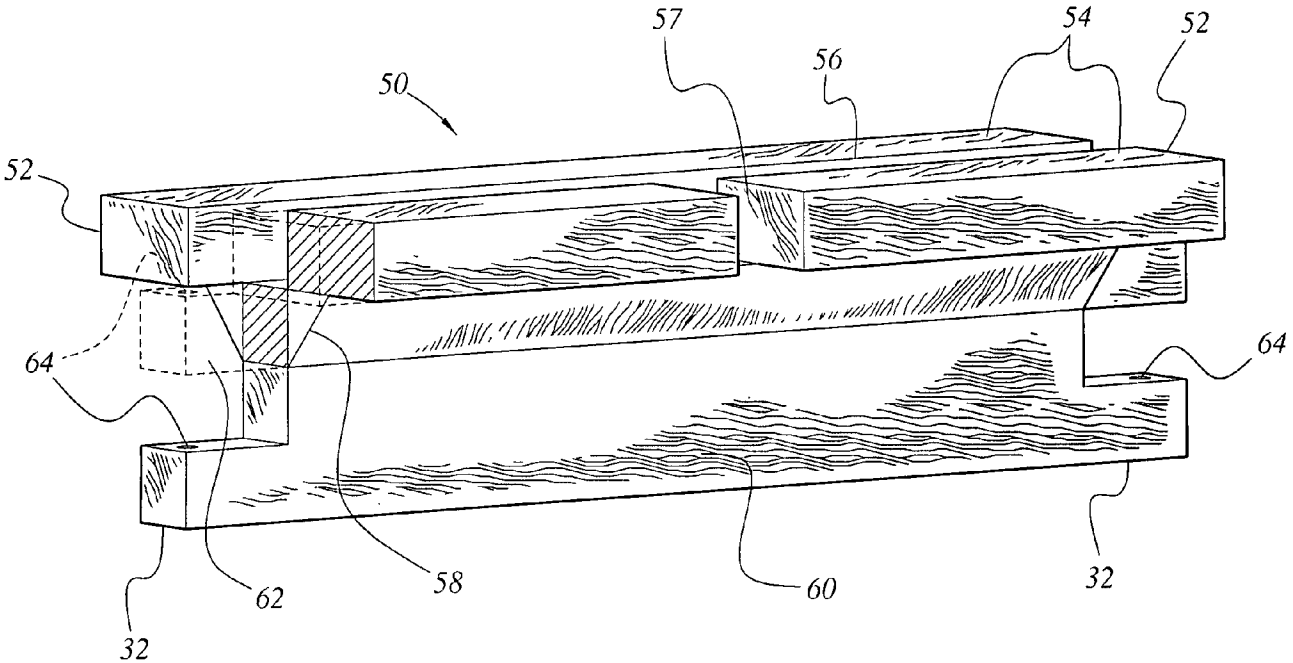
FIG. 2B is a detail view, partially sectional, of FIG. 2A
Figure 4:
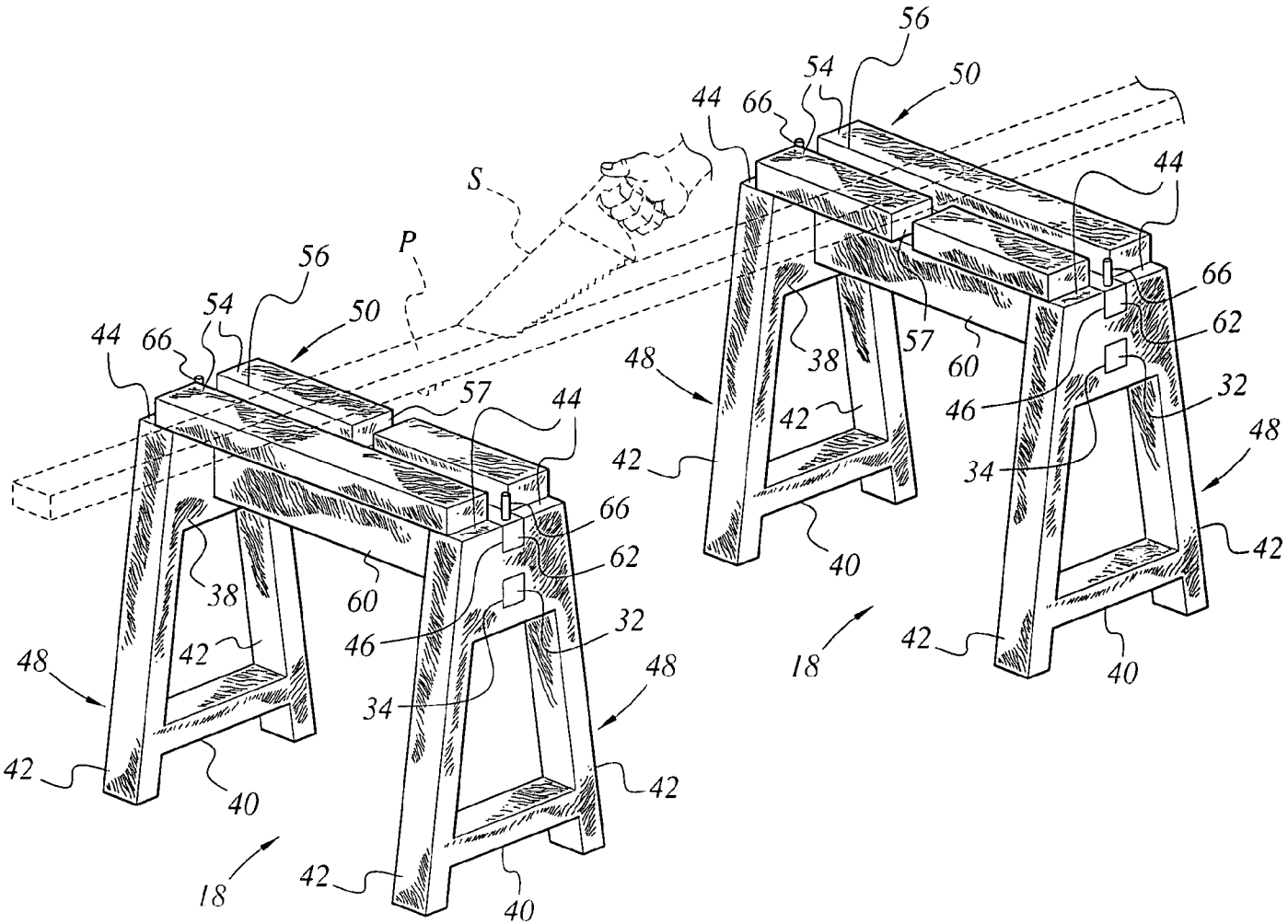
FIG. 4 is a perspective view of the assembled supporting spine and end supports of the table of FIG. 1, useful as a sawhorse.
Figure 6:
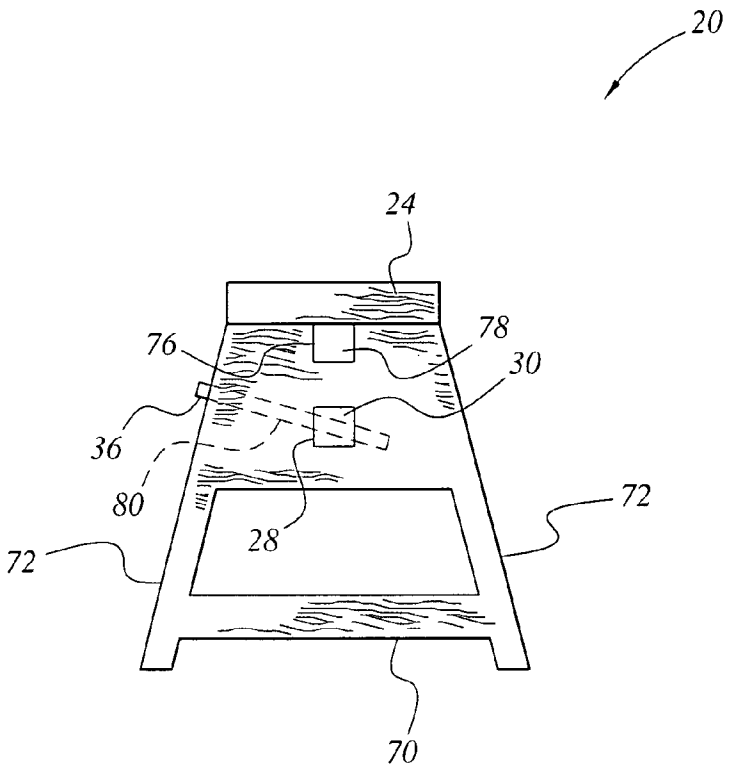
FIG. 6 is an end elevation view of a bench of FIG. 1.

Referring to FIGS. 2, 4, and 6, there are shown an exploded view, an assembled perspective view, and an end elevation view, respectively, of the combination picnic table and sawhorses 12, with table top 14 supported by spaced sawhorse supports 18, also forming the carpenters' sawhorses of the present invention. Tabletop 14 has spaced cross member guides 16 on its underside. Table sawhorse supports 18 have generally "A"-shaped end supports 48, each having an upper cross beam 38, a lower cross beam 40, and opposed legs 42 slanting inward to upper crossbeam surfaces 44, forming the tops of end supports 48, the end supports being truncated at surfaces 44. Each end support 48 has a mortise 34 centrally located through upper cross member 18 and spaced below groove 46 separating upper support surfaces 44.

Table spine 50 is elongate in shape and extends between the two end supports 48. Table spine 50 has opposed ends 52 and a flat top member 54 divided by lengthwise groove 56. A side guide groove 57 is formed by inner facing respective flat top members 54 of each table spine 50. Table spine 50 has a lengthwise, depending spine main support member 60 connected with flat top members 54 by lengthwise support wedges 58 (see FIG. 2A) forming groove 56. Spine main support member 60 forms outward-extending upper tongue 62 and lower tenon 32, spaced therebelow, at each end 52 of spine 50.

As seen in FIG. 4, upon assembly, tongues 62 fit into grooves 46 of end supports 48, and tenons 32 fit into mortises 34, thereof. A securing pin 66 secures spine 50 to each end support 48 by insertion of securing pin 66 into aligned securing pin bores 64 in respective tongues 62 and tenons 32 and corresponding aligned pin bores 65 in upper cross beams 38. The cross member guides 16 of table top 14 fit within cross spine central grooves 56, and table top guide rib 17 extends through side grooves 57 when the inventive structure is used as a picnic table. Cross member guides 16 of table top 12 also have pin bores 67 therein (see FIG. 5), aligned with the pin bores 64 and 65 to receive the upper end of securing pin 66. Spine member 50 may be unitary in construction. Upper surface members 54 of spine 50 extend over upper crossbeam surfaces 44, when assembled. As illustrated in FIG. 4, each assembly 18 of the spine member 50 and table end supports 48 may be used as a sawhorse where plank P is shown with saw S. The various parts of the inventive picnic furniture set is preferably fashioned with 2" lumber or similarly molded to provide solid, durable fittings.

Figure 3:
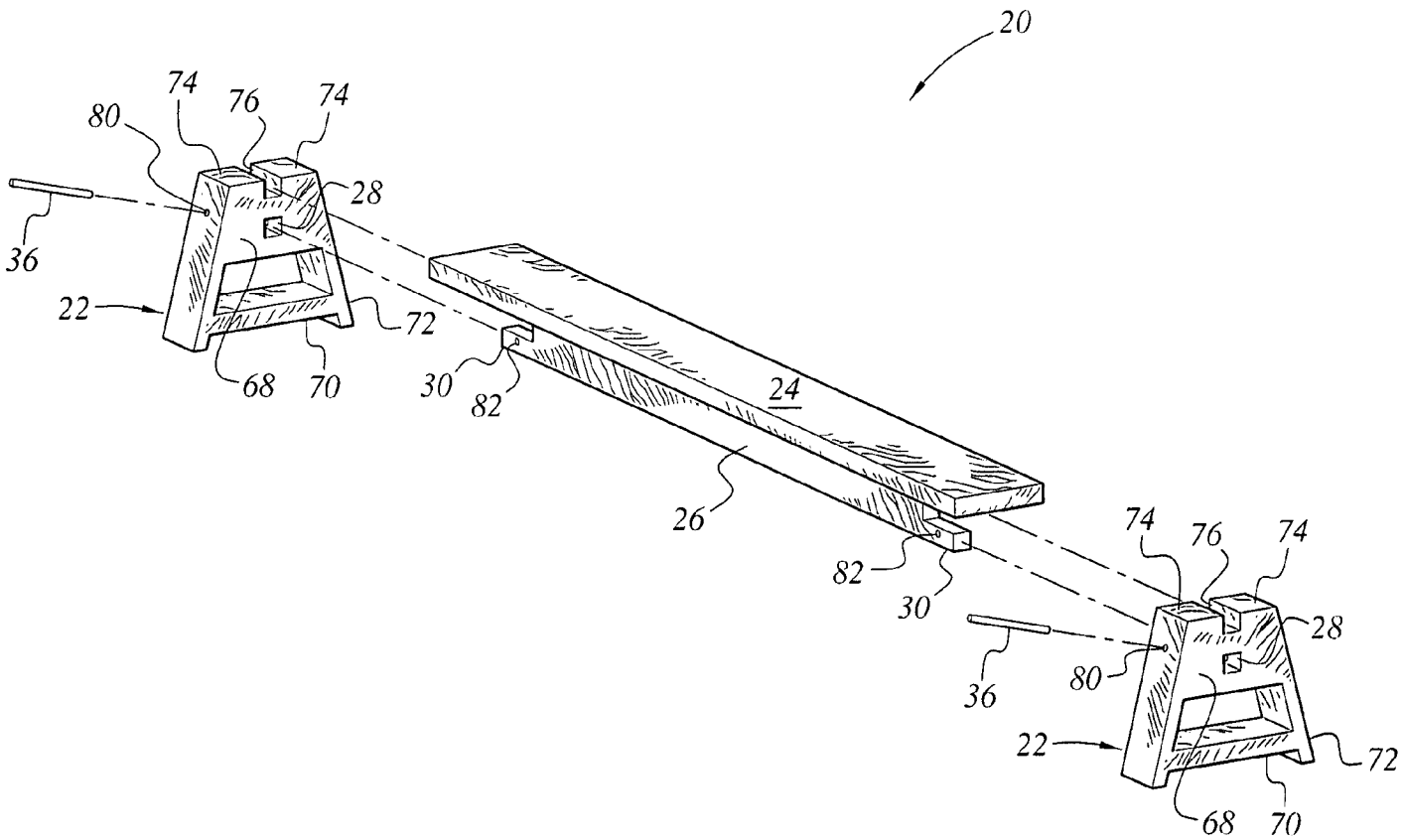
FIG. 3 is an exploded view of one of the benches of FIG. 1.
Figure 5:
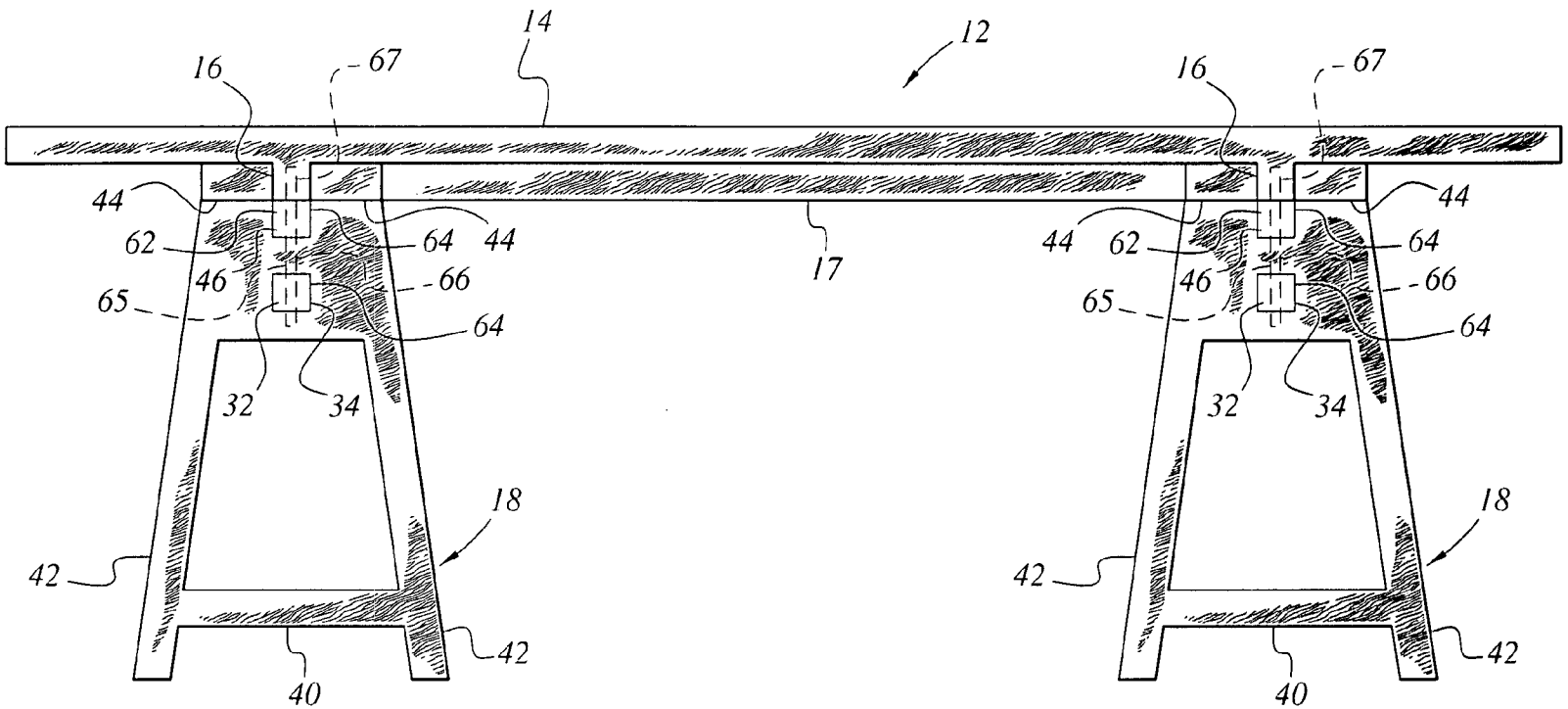
FIG. 5 is an end elevation view of the assembled table of FIG. 1.

Referring to FIGS. 3 and 5, there is shown an exploded view and an assembled end elevation view, respectively, of a bench 20 of the furniture set 10. Bench 20 is similar in design to table 12, having an elongate seat 24 and a depending seat spine member 26. Spine member 26 is integral with seat 24 and has a tenon 30 and tongue 78 extending outward at each end thereof to mate with corresponding mortises 28 and grooves 76 in bench end supports 22, in a similar manner to the assembly of table spine 50 and ends 18 of table 12 as described above. Bench end supports 22 have an upper cross member 68 and a lower cross member 70 and opposed legs 72 forming a generally "A"-shape support, truncated at the upper seat support surfaces 74. A groove 76 separates upper seat support surfaces 74, divided by a groove 76. Grooves 76 and mortises 28 of end supports 22 receive tenons 30 and tongues 78, respectively, upon assembly of bench 20. Securing pins 36 are inserted into diagonal pin bores 80 in end portions 36 and through corresponding aligned bores 82 in tenons 30 to secure the end supports 22 onto bench 20 for use.

The inventive picnic furniture set/sawhorse may be constructed of wood, plastic material, or metal and its construction does not require separate hinges, bolts, or other hardware. The dimensions of the furniture/sawhorse may vary within a reasonable range for use by adults or children as desired.

It is to be understood that the present invention is not limited to the embodiment described above, but encompasses any and all embodiments within the scope of the following claims.

I claim:

1. A portable picnic table/sawhorses, comprising:

a generally rectangular table top having spaced cross member guides on the underside of said table top; and a spaced pair of tabletop sawhorse supports comprising:

a spaced pair of generally triangular sawhorse end supports, each having an upper cross beam, a lower cross beam, and opposed sloping legs, said generally triangular sawhorse end supports being truncated at said upper cross beam, said upper cross beam defining a centrally located groove and a mortise spaced below said groove; and a spine member extending between and having end portions engageable with said table end supports, said spine having upper surface members defining a center groove therebetween and extending downward to form a depending spine joint main support member;

said spine joint main support member forming an upper tongue and a tenon spaced below said upper tongue, each extending from respective ends of said spine joint main support member, said upper tongues and lower tenons being engageable with a corresponding said groove and said mortise in each respective said sawhorse end supports;

said spaced cross member guides being removably inserted in respective said spine center grooves of said spaced pair of table top sawhorse supports to form an assembled picnic table.

2. The portable picnic table/sawhorses of claim 1, further comprising a securing pin corresponding to each of said sawhorse end supports, said upper tongues and lower tenons and said upper cross beams of said sawhorse end supports defining vertically aligned pin bores upon assembly of said sawhorse end supports with said spine member, said securing pins being insertable within said aligned pin bores to form secure joints therebetween.

3. The portable picnic table/sawhorses of claim 2, said upper surface members of said spine member being joined to said spine main support member by support angle members.

4. The portable picnic table/sawhorses of claim 3, said spine member being unitary in structure.

5. The portable picnic table/sawhorses of claim 4, wherein said a generally rectangular table top has a centrally disposed guide rib on its underside extending perpendicularly between said cross member guides, and said upper surface members of respective said spine members of said sawhorse supports define side grooves removably receiving said guide rib upon assembly of said picnic table.

6. The portable picnic table/sawhorses of claim 5, wherein said upper surface members of said spine extend partially over said upper crossbeam surfaces upon assembly of said sawhorse table supports.

7. A bench for use with a picnic table comprising:

an elongate bench seat member having a centrally located spine member depending therefrom; and a pair of generally triangular bench end supports having an upper cross beam, a lower cross beam, and opposed sloping legs, said generally triangular bench end supports being truncated at said upper cross beam to form seat member guide support surfaces thereon, said upper cross beam defining a centrally located groove dividing said guide support surfaces and a mortise spaced below said groove;

said centrally located spine member forming an upper tongue and a tenon spaced below said upper tongue, each extending from respective ends of said spine joint main support member, said upper tongues and lower tenons being engageable with a corresponding said groove and said mortise in each respective said bench end supports.

8. The bench of claim 7, further comprising a securing pin corresponding to each said upper cross beam of said bench end supports and said respective bench end tenon upon assembly defining aligned pin bores for receiving said securing pins for securing the assembly of said bench.

9. The bench of claim 8, wherein said bench seat member and said bench seat spine member are unitary in structure.

10. A portable picnic table/sawhorse and bench furniture set, comprising:

a picnic table/sawhorse comprising:

a generally rectangular table top having spaced cross member guides on the underside of said table top; and a spaced pair of tabletop sawhorse supports comprising:

a spaced pair of generally triangular sawhorse end supports, each having an upper cross beam, a lower cross beam, and opposed sloping legs, said generally triangular sawhorse end supports being truncated at said upper cross beam, said upper cross beam defining a centrally located groove and a mortise spaced below said groove; and a spine member extending between and having end portions engageable with said table end supports, said spine having upper surface members defining a center groove therebetween and extending downward to form a depending spine joint main support member;

said spine joint main support member forming an upper tongue and a tenon spaced below said upper tongue, each extending from respective ends of said spine joint main support member, said upper tongues and lower tenons being engageable with a corresponding said groove and said mortise in each respective said sawhorse end supports;

said spaced cross member guides being removably inserted in respective said spine center grooves of said spaced pair of table top sawhorse supports to form an assembled picnic table; and a pair of benches, each said bench comprising:

an elongate bench seat member having a centrally located spine member depending therefrom; and a pair of generally triangular bench end supports having an upper cross beam, a lower cross beam, and opposed sloping legs, said generally triangular bench end supports being truncated at said upper cross beam to form seat member guide support surfaces thereon, said upper cross beam defining a centrally located groove dividing said guide support surfaces and a mortise spaced below said groove;

said centrally located spine member forming an upper tongue and a tenon spaced below said upper tongue, each extending from respective ends of said spine joint main support member, said upper tongues and lower tenons being engageable with corresponding said groove and said mortise in each respective said bench end supports.

11. The portable picnic table/sawhorses set of claim 10, further comprising a securing pin corresponding to each of said sawhorse end supports, said upper tongues and lower tenons and said upper cross beams of said sawhorse end supports defining vertically aligned pin bores upon assembly of said sawhorse end supports with said spine member, said securing pins being insertable within said aligned pin bores to form secure joints therebetween.

12. The portable picnic table/sawhorses set of claim 10, said upper surface members of said spine member being joined to said spine main support member by support angle members.

13. The portable picnic table/sawhorses set of claim 10, said spine member being unitary in structure.

14. The portable picnic table/sawhorses set of claim 10, wherein said a generally rectangular table top has a centrally disposed guide rib on its underside extending perpendicularly between said cross member guides, and said upper surface members of respective said spine members of said sawhorse supports define side grooves removably receiving said guide rib upon assembly of said picnic table.

15. The portable picnic table/sawhorses of claim 14, wherein said upper surface members of said spine extend partially over said upper crossbeam surfaces upon assembly of said sawhorse table supports.

16. The portable picnic table/sawhorse and bench furniture set of claim 10, further comprising a securing pin corresponding to each said upper cross beam of said bench end supports and said respective bench end tenon upon assembly defining aligned pin bores for receiving said securing pins for securing the assembly of said bench.

17. The portable picnic table/sawhorse and bench furniture set of claim 16, wherein said bench seat member and said bench seat spine member are unitary in structure.

* * * * *